US007746047B2

(12) United States Patent
Yin et al.

(10) Patent No.: US 7,746,047 B2
(45) Date of Patent: Jun. 29, 2010

(54) LOW DROPOUT VOLTAGE REGULATOR WITH IMPROVED VOLTAGE CONTROLLED CURRENT SOURCE

(75) Inventors: Hang Yin, Beijing (CN); Zhao Wang, Beijing (CN)

(73) Assignee: Vimicro Corporation, Beijing (CN)

( * ) Notice: Subject to any disclaimer, the term of this patent is extended or adjusted under 35 U.S.C. 154(b) by 403 days.

(21) Appl. No.: 12/018,200

(22) Filed: Jan. 23, 2008

(65) Prior Publication Data

US 2008/0284394 A1 Nov. 20, 2008

(30) Foreign Application Priority Data

May 15, 2007 (CN) ..... 2007 1 0099170

(51) Int. Cl.
*G05F 1/40* (2006.01)
*G05F 3/04* (2006.01)

(52) U.S. Cl. ..... 323/273; 323/312; 323/315

(58) Field of Classification Search ..... 323/273, 323/274, 275, 280, 284, 285, 312, 315, 316
See application file for complete search history.

(56) References Cited

U.S. PATENT DOCUMENTS

| | | | | |
|---|---|---|---|---|
| 5,867,015 | A * | 2/1999 | Corsi et al. | 323/316 |
| 6,201,375 | B1 * | 3/2001 | Larson et al. | 323/277 |
| 6,559,623 | B1 * | 5/2003 | Pardoen | 323/274 |
| 7,030,677 | B2 * | 4/2006 | Pannwitz | 327/314 |
| 7,253,595 | B2 * | 8/2007 | Oddoart et al. | 323/274 |
| 7,615,977 | B2 * | 11/2009 | Gicquel et al. | 323/273 |
| 7,656,224 | B2 * | 2/2010 | Perez et al. | 327/540 |
| 2005/0225306 | A1 * | 10/2005 | Oddoart et al. | 323/274 |

* cited by examiner

*Primary Examiner*—Adolf Berhane
(74) *Attorney, Agent, or Firm*—Wuxi Sino IP Agency, Ltd.; Joe Zheng

(57) ABSTRACT

Techniques pertaining to designs of a compensation voltage controlled current source (VCCS) used in low dropout voltage regulators are disclosed. According to one aspect of the present invention, a compensation voltage controlled current source (VCCS) is so designed to meet the low input/output voltage requirements. Various features of the VCCS are demonstrated through several embodiments.

15 Claims, 6 Drawing Sheets

LOW DROPOUT VOLTAGE REGULATOR WITH IMPROVED VOLTAGE CONTROLLED CURRENT SOURCE

BACKGROUND OF THE INVENTION

1. Field of the Invention

The present invention relates to a voltage regulator, more particularly to a low dropout voltage regulator with an improved voltage controlled current source.

2. Description of Related Art

Voltage regulators with low dropout (LDO) are widely used in power management systems of PC motherboards, notebooks computers, mobile phones, and many other products. As a voltage supply, the LDO voltage regulator demonstrates many advantages in the field. Perfect line and load regulation, high power supply rejection ratio (PSRR), fast response, very small quiescent current, and low noise make the LDO voltage regulator irreplaceable. Stabilizing the LDO voltage regulator with 1 uF low ESR (equivalent series resistance) ceramic capacitor under a large output current is still a challenge.

FIG. 1 shows a typically conventional LDO voltage regulator 100 with a compensation voltage controlled current source (VCCS). The specific description to the conventional LDO voltage regulator may be referred in a reference entitled "A Frequency Compensation Scheme for LDO Voltage Regulators", invented by Chaitanya K. Chava and Jose Silva-Martinez, published on IEEE J. Solid-State Circuits, vol. 51, pp. 1041-1050, June 2004, which is hereby incorporated by reference.

The LDO voltage regulator 100 comprises a differential amplifier circuit 102, an intermediate amplifier circuit 104, an output pass circuit 106, a feedback circuit 108 and a voltage controlled current source (VCCS) 110. These circuits are intercoupled to form a voltage negative feedback loop.

The differential amplifier circuit 102 includes a differential amplifier gm1, a resistor $R_1$ and a capacitor $C_1$ coupled in parallel between an output terminal of the differential amplifier gm1 and a ground reference. The resistor $R_1$ and the capacitor $C_1$ may be an equivalent series resistance (ESR) and an equivalent series capacitance (ESC) of the differential amplifier circuit, respectively.

The intermediate amplifier circuit 104 includes an amplifier gm2 a resistor $R_2$ and a capacitor $C_2$ coupled in parallel between an output terminal of the amplifier gm2 and the ground reference. An input terminal of the amplifier gm2 is coupled to the output terminal of the differential amplifier gm1. The resistor $R_2$ and the capacitor $C_2$ may be the ESR and the ESC of the intermediate amplifier circuit, respectively.

The output pass circuit gm3 106 includes a pass transistor MPass and an output capacitor Co. The pass transistor MPass is usually a P-type MOS field effect transistor. A control terminal of the pass transistor MPass such as a gate electrode of the MOS transistor is coupled to the output terminal of the amplifier gm2. An input terminal of the pass transistor MPass such as a source electrode of the MOS transistor is coupled to a power supply Vcc. An output voltage Vout is leaded from an output terminal of the pass transistor MPass such as a drain electrode of the MOS transistor. The output capacitor Co and a resistor $R_L$ representative of a load are coupled in parallel between the output voltage Vout and the ground reference.

The feedback circuit 108 includes a pair of ladder resistors $R_{f1}$ and $R_{f2}$ coupled in series between the output voltage Vout and the ground reference. One terminal of the resistor $R_{f1}$ is coupled to the output terminal of the pass transistor MPass. A middle node B between the resistor $R_{f1}$ and the resistor $R_{f2}$ is coupled to an input terminal of the differential amplifier gm1 for feedback. Another input terminal of the differential amplifier is coupled to a predetermined reference voltage.

An input terminal of the VCCS 110 is coupled to a node A between the pass transistor and the feedback circuit, and an output terminal of the voltage controlled current source circuit is coupled to the node B. The VCCS 110 is designed for outputting a constant current into the node B depending on a voltage of the input terminal thereof. The VCCS 110 includes a NMOS transistor MN1, a current mirror, a first current source I1, a second current source I2 and a compensation capacitor $C_C$. A gate electrode of the MN1 serves as the input terminal of the VCCS, a drain electrode of the MN1 is coupled to an input terminal of the current mirror and a source electrode of the MN1 is coupled to a terminal of the first current source I1. The other terminal of the first current source I1 is grounded. One terminal of the compensation capacitor $C_C$ is coupled to the source electrode of the MN1, and the other terminal of the compensation capacitor $C_C$ is grounded. One terminal of the second current source I2 is grounded, and the other terminal of the second current source I2 serves as the output terminal of the VCCS 110. An output terminal of the current mirror is coupled to the output terminal of the VCCS 110.

A small signal transfer function of the VCCS 110 is shown below:

$$\frac{I_{fb}}{V_O} = \frac{SC_C}{1 + \frac{SC_C}{gm_{MN1}}} \tag{1}$$

where $I_{fb}$ denotes an output current of VCCS, $V_O$ denotes a control voltage of the VCCS namely the output voltage Vout, $SC_C$ denotes a conductance of the compensation capacitor $C_C$ and $gm_{MN1}$ denotes a transconductance between the drain and source electrodes of the MN1.

A minimum operating supply voltage for the LDO voltage regulator is $V_{drop_I1} + V_{drop_CurrentMirror} + V_{dsat_MN1}$, wherein $V_{drop_I1}$ denotes a dropout voltage on the first current source I1, $V_{drop_CurrentMirror}$ denotes a dropout voltage on the current mirror and $V_{dsat_MN1}$ denotes a saturated dropout voltage between the drain and source electrodes of the MN1. A minimum output voltage of the LDO voltage regulator is $V_{th_MN1} + V_{drop_I1}$, wherein $V_{th_MN1}$ denotes a threshold voltage of the MN1.

In the standard CMOS, a body effect of the NMOS transistor can't be neglected. Usually, the NMOS transistor is formed on a substrate thereof directly. In FIG. 1, the body effect of the MN1 may degrade its performance. If the body effect is considered, the equation (1) may become:

$$\frac{I_{fb}}{V_O} = \frac{SC_C}{1 + \frac{SC_C}{(gm_{MN1} - gmb_{MN1})}} \tag{2}$$

An item $gmb_{MN1}$ which denotes a body effect conductance of the MN1 is added.

The minimum output voltage of the LDO voltage regulator is adversely affected because the threshold voltage of the MN1 $V_{th_MN1}$ has a relation to the body effect of the MN1 according to following equation.

$$V_{th_MN1} = V_{th0} + \gamma(\sqrt{V_{SB} + 2\phi_F} - \sqrt{2\phi_F}) \tag{3}$$

where $V_{th0}$ denotes an intrinsic threshold voltage of the MN1, γ denotes a body effect constant, $V_{SB}$ denotes a dropout voltage between the source electrode and the substrate of the MN1 and $\phi_F$ denotes a fermi potential. The threshold voltage of the MN1 $V_{th_MN1}$ may become higher because the dropout voltage $V_{SB}$ is larger than zero, thereby the minimum output voltage can't be low enough. This should limit the applications of the LDO voltage regulator.

The LDO voltage regulator is mainly used to supply power for system level chips. With the size of system level chips gradually being reduced, supply voltages required by the system level chips are reduced in proportion. Hence, the LDO voltage regulator is required to operate with the low input voltage and the low output voltage. In some cases, the output voltage of the LDO voltage regulator may be 1.2V or more lower, and the input voltage of the LDO voltage regulator may be 2V or more lower.

However, the threshold voltage $V_{th}$ of the NMOS transistor in standard CMOS process commonly is 0.7V~1.1V and can't be adjusted. Furthermore, a maximum technical error 1.0V should be considered usually. The dropout voltage $V_{drop_I1}$ commonly is 0.4~0.8V since it is twice of the saturated dropout voltage $V_{dsat}$, which is 0.2~0.4V, between the gate and source electrodes of the NMOS transistor in standard CMOS process. Hence, the minimum output voltage $V_{th_MN1}+V_{drop_I1}$ of the LDO voltage regulator shown in FIG. 1 may be higher than 1.5V. At the same time, the dropout voltage $V_{drop_CurrentMirror}$ on the current mirror is approximately equal to $V_{dsat}+V_{th}$, thereby the minimum operating supply voltage $V_{drop_I1}+V_{drop_CurrentMirror}+V_{dsat_MN1}$ for the LDO voltage regulator may be higher than 1.9V. As a result, the conventional LDO voltage regulator may not completely satisfy the low input/output voltage requirements.

Thus, there is a need for LDO voltage regulators with an improved VCCS to overcome the above disadvantages.

SUMMARY OF THE INVENTION

This section is for the purpose of summarizing some aspects of the present invention and to briefly introduce some preferred embodiments. Simplifications or omissions in this section as well as in the abstract or the title of this description may be made to avoid obscuring the purpose of this section, the abstract and the title. Such simplifications or omissions are not intended to limit the scope of the present invention.

In general, the present invention is related to designs of a compensation voltage controlled current source (VCCS) used in low dropout voltage regulators. According to one aspect of the present invention, a compensation voltage controlled current source (VCCS) is so designed to meet the low input/output voltage requirements. In one embodiment, a LDO voltage regulator comprises:

a differential amplifier circuit having a pair of input terminals and an output terminal, one input terminal coupled to a predetermined reference voltage;

an intermediate amplifier circuit having an output terminal and an input terminal coupled to the output terminal of the differential; and an output pass circuit comprising a pass transistor and an output capacitor, the pass transistor having a control terminal coupled to the output terminal of the intermediate amplifier circuit, an input terminal coupled to a power supply and an output terminal taken as a voltage output node, the output capacitor coupled between the voltage output node and a ground reference;

a feedback circuit comprising a pair of ladder resistors coupled in series between the voltage output node and the ground reference, a node between the ladder resistors coupled to the other input terminal of the differential amplifier circuit; and a voltage controlled current source (VCCS) having an input terminal coupled to the voltage output node and an output terminal coupled to the node between the ladder resistors; wherein the VCCS comprises four NMOS field effect transistors MN1, MN2, MN3 and MN4, a current mirror and a compensation capacitor $C_c$, a gate electrode of the MN1 is coupled to a first predetermined voltage Vb1 and a source electrode of the MN1 is grounded, a gate electrode of the MN2 is coupled to the first predetermined voltage Vb1 and a source electrode of the MN2 is grounded, a gate electrode of the MN3 is coupled to a second predetermined voltage Vb2, a source electrode of the MN3 is coupled to a drain electrode of the MN1 and a drain electrode of the MN3 is coupled to an input terminal of the current mirror, a gate electrode of the MN4 is coupled to the second predetermined voltage Vb2, a source electrode of the MN4 is coupled to a drain electrode of the MN2 and a drain electrode of the MN4 is coupled to an output terminal of the current mirror, the drain electrode of the MN4 serves as the output terminal of the VCCS, one terminal of the compensation capacitor $C_c$ is coupled to the drain electrode of the MN2 and the other terminal of the compensation capacitor $C_c$ serves as the input terminal of the VCCS.

There are many objects, features, and advantages in the present invention, which will become apparent upon examining the following detailed description of an embodiment thereof, taken in conjunction with the attached drawings.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The detailed description of the present invention is presented largely in terms of procedures, steps, logic blocks, processing, or other symbolic representations that directly or indirectly resemble the operations of devices or systems contemplated in the present invention. These descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams or the use of sequence numbers representing one or more embodiments of the invention do not inherently indicate any particular order nor imply any limitations in the invention.

Embodiments of the present invention are discussed herein with reference to FIGS. 2-7. However, those skilled in the art will readily appreciate that the detailed description given herein with respect to these figures is for explanatory purposes only as the invention extends beyond these limited embodiments.

Figure 2:
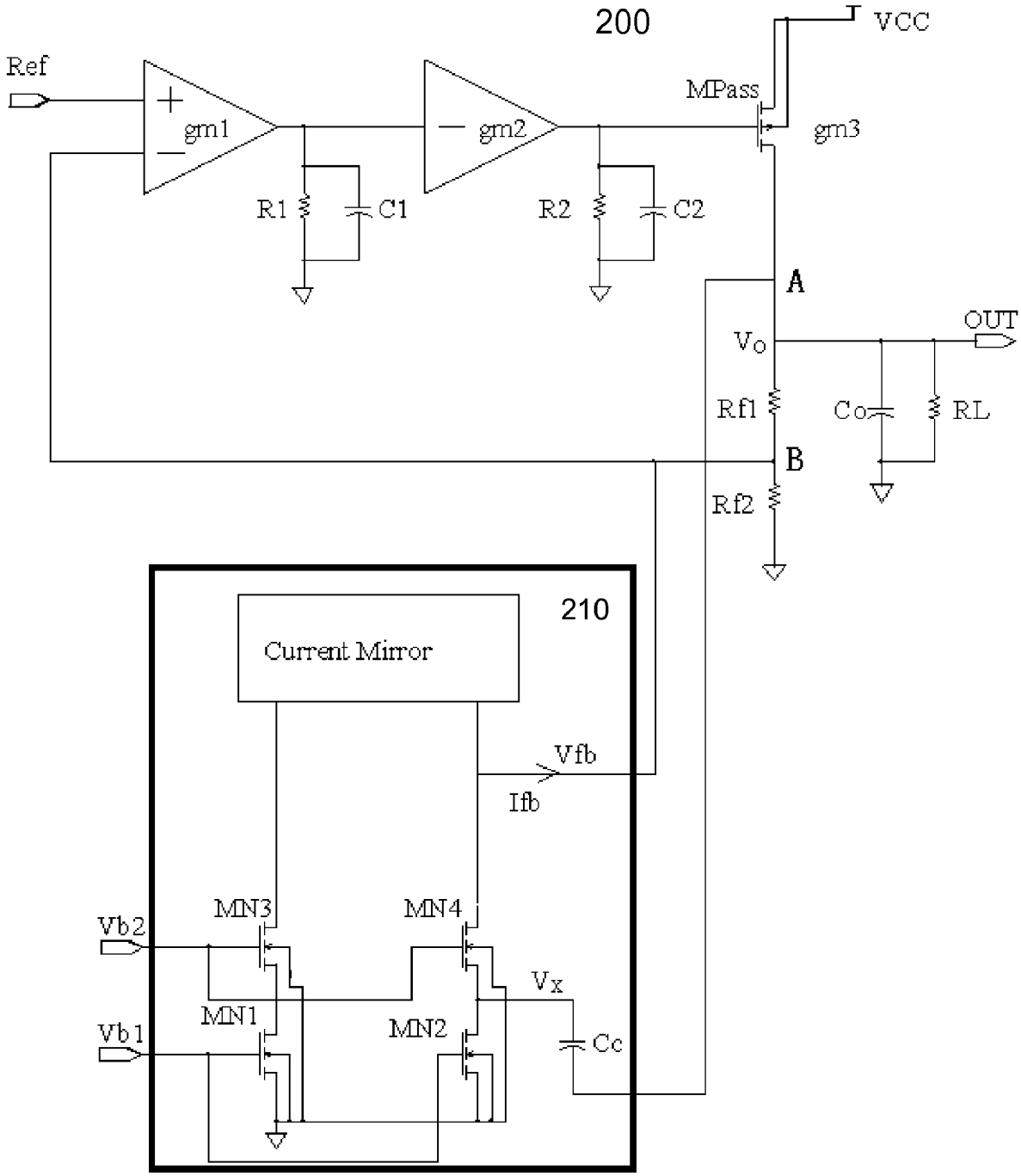
FIG. 2 shows a LDO voltage regulator with an improved VCCS according to a first embodiment of the present invention.

Several embodiments are provided to fully describe a low dropout (LDO) voltage regulator with an improved voltage controlled current source (VCCS) in the present invention. FIG. 2 shows an exemplary LDO voltage regulator 200 according to one embodiment of the present invention. The LDO voltage regulator 200 of FIG. 2 has a similar structure with the LDO voltage regulator in the prior art except for the VCCS 210. The VCCS 210 according to the embodiment of the present invention comprises four NMOS field effect transistors MN1, MN2, MN3 and MN4, a current mirror and a compensation capacitor $C_c$. A gate electrode of the MN1 is coupled to a first predetermined voltage Vb1 and a source electrode of the MN1 is grounded. A gate electrode of the MN2 is coupled to the first predetermined voltage Vb1 and a source electrode of the MN2 is grounded. Agate electrode of the MN3 is coupled to a second predetermined voltage Vb2, a source electrode of the MN3 is coupled to a drain electrode of the MN1 and a drain electrode of the MN3 is coupled to an input terminal of the current mirror. A gate electrode of the MN4 is coupled to the second predetermined voltage Vb2, a source electrode of the MN4 is coupled to a drain electrode of the MN2 and a drain electrode of the MN4 is coupled to an output terminal of the current mirror. The drain electrode of the MN4 serves as an output terminal of the VCCS and is coupled to a node B between resistors $R_{f1}$ and $R_{f2}$ of a feedback circuit. One terminal of the compensation capacitor $C_c$ is coupled to the drain electrode of the MN2, and the other terminal of the compensation capacitor $C_c$ serves as an input terminal of the VCCS and is coupled to a node A between a pass transistor MPass and the feedback circuit.

The improved VCCS 210 is designed for injecting only a small signal current into the node B shown in FIG. 2. In another word, there is no direct current injected into the node B. In order to ensure that the direct current injected into the node B is zero, a direct current which flows out of the current mirror after a direct current of the MN1 and MN3 pass through the current mirror is required to be equal to a direct current of the MN2 and MN4. In one embodiment, the gate voltages of the MN1 and the MN2 are equal and both are Vb1, so a ratio of the direct current of the MN2 to the direct current of the MN1 is $(W/L)_{MN2}/(W/L)_{MN1}$, wherein $(W/L)_{MN2}$ denotes a ratio of width to length of the MN2, $(W/L)_{MN1}$ denotes a ratio of width to length of the MN1. The width or length means a geometric size of the MOS transistor. Provided that a ratio of an input direct current to an output direct current of the current mirror is M, so $(W/L)_{MN2}/(W/L)_{MN1}$ should be equal to M in this embodiment. For further matching the direct currents of the MN3 and the MN4, the ratios of width to length of the MN3 and the MN4 should satisfy $(W/L)_{MN4}/(W/L)_{MN3}=(W/L)_{MN2}/(W/L)_{MN1}$. Thus, the direct current flowing out of the current mirror may be cancelled by the direct current of the MN2 and the MN4 so that there is no direct current injected into the node B.

Figure 3:
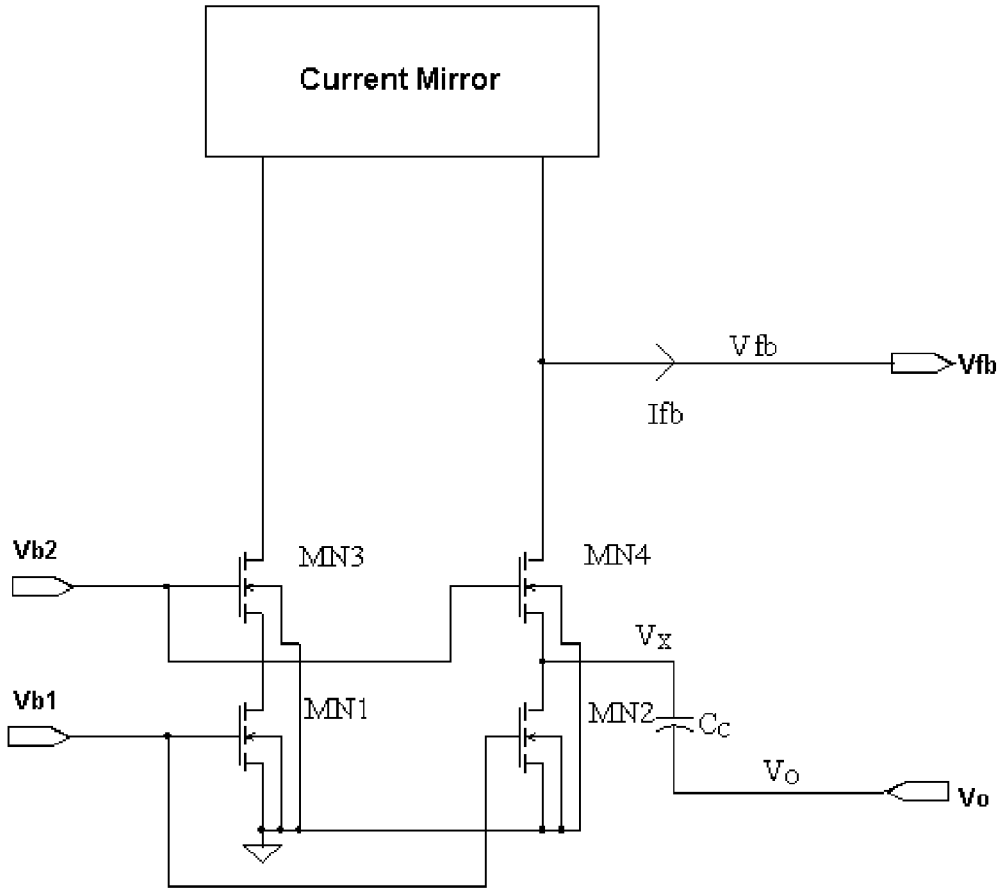
FIG. 3 is a circuit diagram showing the improved VCCS in FIG. 2.

FIG. 3 is a circuit diagram showing the improved VCCS used in FIG. 2.

Figure 4:
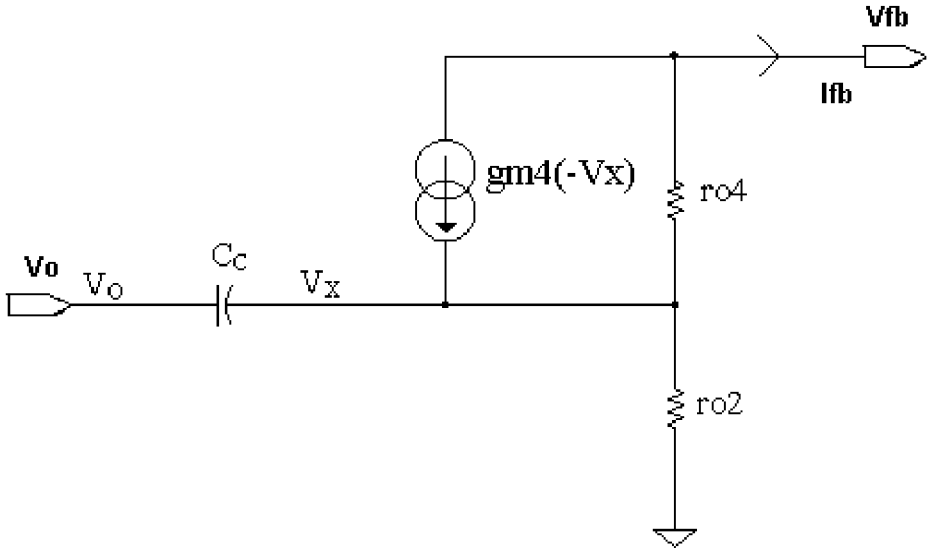
FIG. 4 is a diagram showing a small signal equivalence circuit of FIG. 3.

FIG. 4 is a small signal equivalence circuit diagram of FIG. 3. For simplifying analysis, an output resistor Ro2 of the MN2 and an output resistor Ro4 of the MN4 is neglected since the resistances thereof are such big that an open circuit is equivalent. Usually, a condition of gm4>>1/ro2 should be satisfied, wherein much more than means that one value is an order of magnitude higher than the other value, e.g. gm4>10/ro2. According to KCL (Kirchhoff's Current Law), following equations are got.

$$(V_O-V_X)SC_C+gm4(-V_X)=0$$

$$gm4(-V_X)+I_{fb}=0$$

Solve these equations:

$$I_{fb}=V_O SC_C\frac{gm4}{gm4+SC_C}$$

Then, following equation is got.

$$\frac{I_{fb}}{V_O}=\frac{SC_C}{1+\frac{SC_C}{gm4}} \tag{4}$$

where gm4 denotes a transconductance between the drain electrode and the source electrode of the MN4, Vx denotes a voltage of a node between the MN2 and the MN4, $SC_C$ denotes a conductance of the compensation capacitor $C_c$, and $I_{fb}$ denotes the output current of the VCCS.

Referring to FIG. 4, when a body effect of the NMOS transistor is considered, the equation (4) may become:

$$\frac{I_{fb}}{V_O}=\frac{SC_C}{1+\frac{SC_C}{(gm4+gmb4)}} \tag{5}$$

An item gmb4 which denotes a body effect conductance of the MN4 is added. Comparing the equation (5) to the equation (2), gm4+gmb4 in the present invention is larger than $gm_{MN1}-gmb_{MN1}$ in the prior art because both $gmb_{MN1}$ and gmb4 are positive, gm4 is approximately equal to gm1 and $gmb_{MN1}$ is approximately equal to gmb4. Hence, a frequency $$\frac{(gm4+gmb4)}{2\pi C_C}$$

of an undesirable pole in the present invention is higher than a frequency $$\frac{(gm_{MN1} - gmb1_{MN1})}{2\pi C_C}$$

of an undesirable pole in the prior art so that the undesirable pole in the present invention is more apt to be neglected. It can be observed that gmb4 helps to push the undesirable pole to high frequency. As a result, the stability of the LDO voltage regulator is compensated by the improved VCCS.

In the present invention, a minimum output voltage of the LDO voltage regulator shown in FIG. 2 is $V_{dsat_MN2}$, wherein $V_{dsat_MN2}$ denotes a saturated dropout voltage between the drain and source electrodes of the MN2. The saturated dropout voltage between the gate and source electrodes of the NMOS transistor in standard CMOS process is 0.2~0.4V and can be adjusted by size of elements. However, the threshold voltage $V_{th}$ of the NMOS transistor in standard CMOS process commonly is 0.7V~1.1V and can't be adjusted. Furthermore, a maximum technical error 1.0V should also be also considered. Hence, the minimum output voltage, which is 0.2~0.4V, of the LDO voltage regulator shown in FIG. 2 is lower than the minimum output voltage $V_{th_MN1}+V_{drop_I1}$ of the LDO voltage regulator in the prior art. An operating supply voltage for the LDO voltage regulator shown in FIG. 2 is $V_{dsat_MN1}+V_{dsat_MN2}+V_{drop_CurrentMirror}$, wherein the dropout voltage $V_{drop_CurrentMirror}$ on the current mirror is approximately equal to $V_{dsat}+V_{th}$. If $V_{dsat}$ is designed to be 0.2V and the maximum $V_{th}$ 1.1v is considered, then the minimum operating supply voltage for the LDO voltage regulator shown in FIG. 2 is 1.7V, which is lower than the minimum operation supply voltage 1.9V for the LDO voltage regulator in the prior art.

Figure 1:
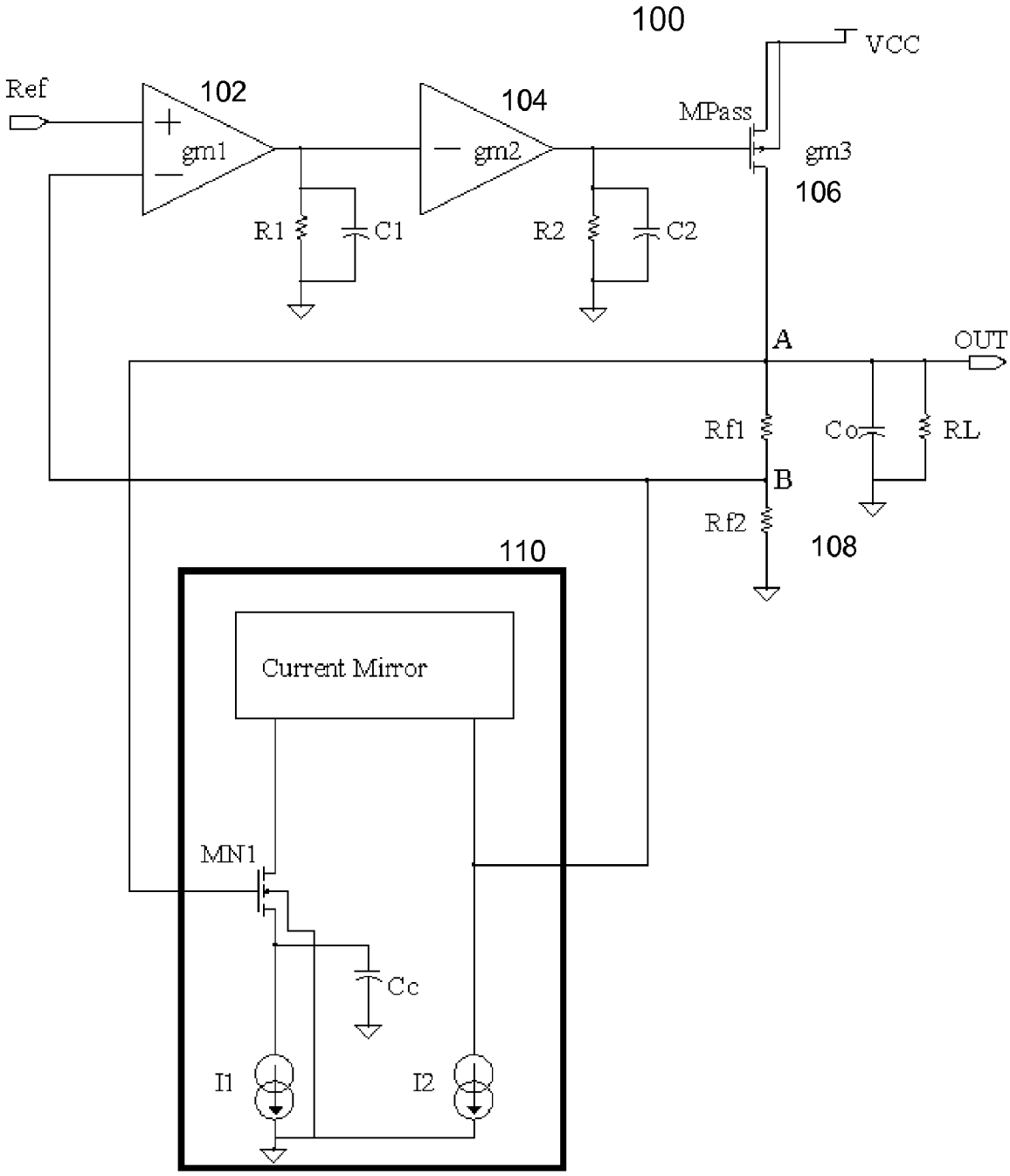
FIG. 1 (prior art)
FIG. 1 shows a conventional LDO voltage regulator with a compensation voltage controlled current source (VCCS)

In FIG. 1, an output capacitor Co and an ESR (not shown) of the output capacitor Co forms a zero. The zero frequency is shown in an equation below:

$$f_{ESR} = \frac{1}{2\pi R_{ESR} C_o}$$

For the small ceramic output capacitor Co with low ESR, the zero $f_{ESR}$ can be neglected usually because it is at a very high frequency.

In FIG. 1, there are three poles and one zero listed hereafter:

$$f_{P1} = \frac{1}{2\pi R_1 C_1},\ f_{P2} = \frac{1}{2\pi R_2 C_2},\ f_{P3} = \frac{1}{2\pi R_L C_O},$$

$$f_{Z1} = \frac{1}{2\pi R_{f1} C_C}$$

where the pole $f_{p1}$ is formed by the output resistor $R_1$ and the output capacitor $C_1$ of the differential amplifier circuit. The pole $f_{p2}$ is formed by the output resistor $R_2$ and the output capacitor $C_2$ of the intermediate amplifier circuit. The pole $f_{p3}$ is formed by the load resistor RL and the output capacitor $C_2$ of the output pass circuit. To stabilize the voltage negative feedback loop, one zero must be designed to cancel one pole, another pole must be pushed beyond the cross-over frequency and only one pole may be designed to be a domain pole. In the reference mentioned above, the pole $f_{P3}$ is designed to be the dominant pole, the zero $f_{Z1}$ is designed to cancel the pole $f_{p2}$, and the pole $f_{P1}$ is pushed to high frequency beyond bandwidth. It should be noted that the pole $f_{p2}$ may be cancelled by the zero $f_{Z1}$ as long as the zero $f_{Z1}$ is adjacent to the pole $f_{p2}$, but not requiring the zero $f_{Z1}$ to be equal to the pole $f_{p2}$.

However, in order to push the pole $f_{P1}$ to high frequency, the differential amplifier circuit must be designed with very small size to minimize capacitance and resistance at the signal path thereof. It may lead to big mismatch. At the same time, the bandwidth is limited and the PSRR over 10 KHz may be poor.

Figure 5:
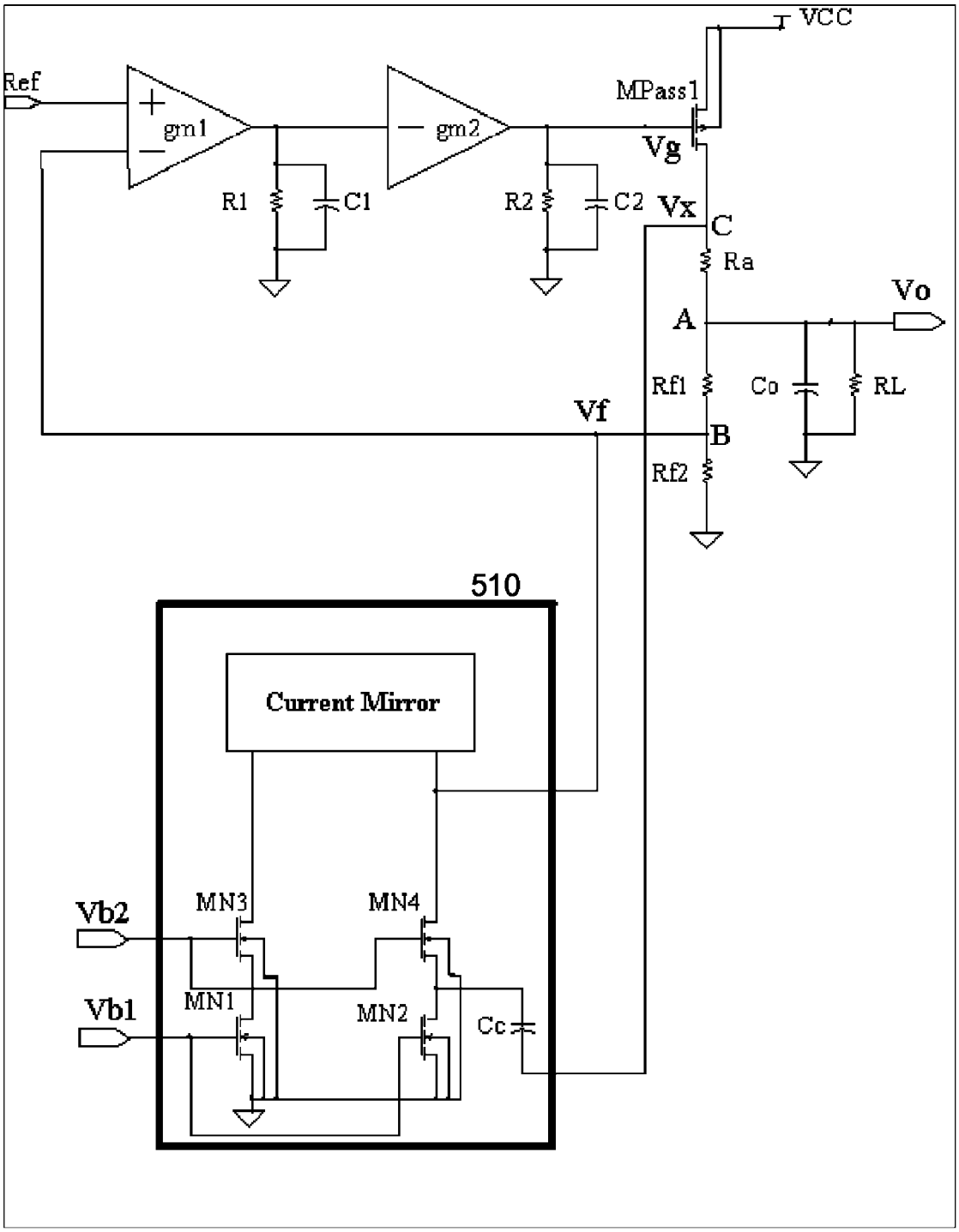
FIG. 5 is a circuit diagram showing the LDO voltage regulator according to a second embodiment of the present invention.

In order to overcome the above problem, the LDO voltage regulator according to the second embodiment is proposed in the present invention. FIG. 5 shows the LDO voltage regulator according to the second embodiment of the present invention. The LDO voltage regulator shown in FIG. 5 has two differences from the LDO voltage regulator shown in FIG. 2. One is that a resistor Ra is added between an output terminal of a pass transistor MPass and a voltage output node A. The other is that the input terminal of the improved VCCS is coupled to a node C between the pass transistor MPass and the resistor $R_a$. With the new structure, another zero is added.

Figure 6:
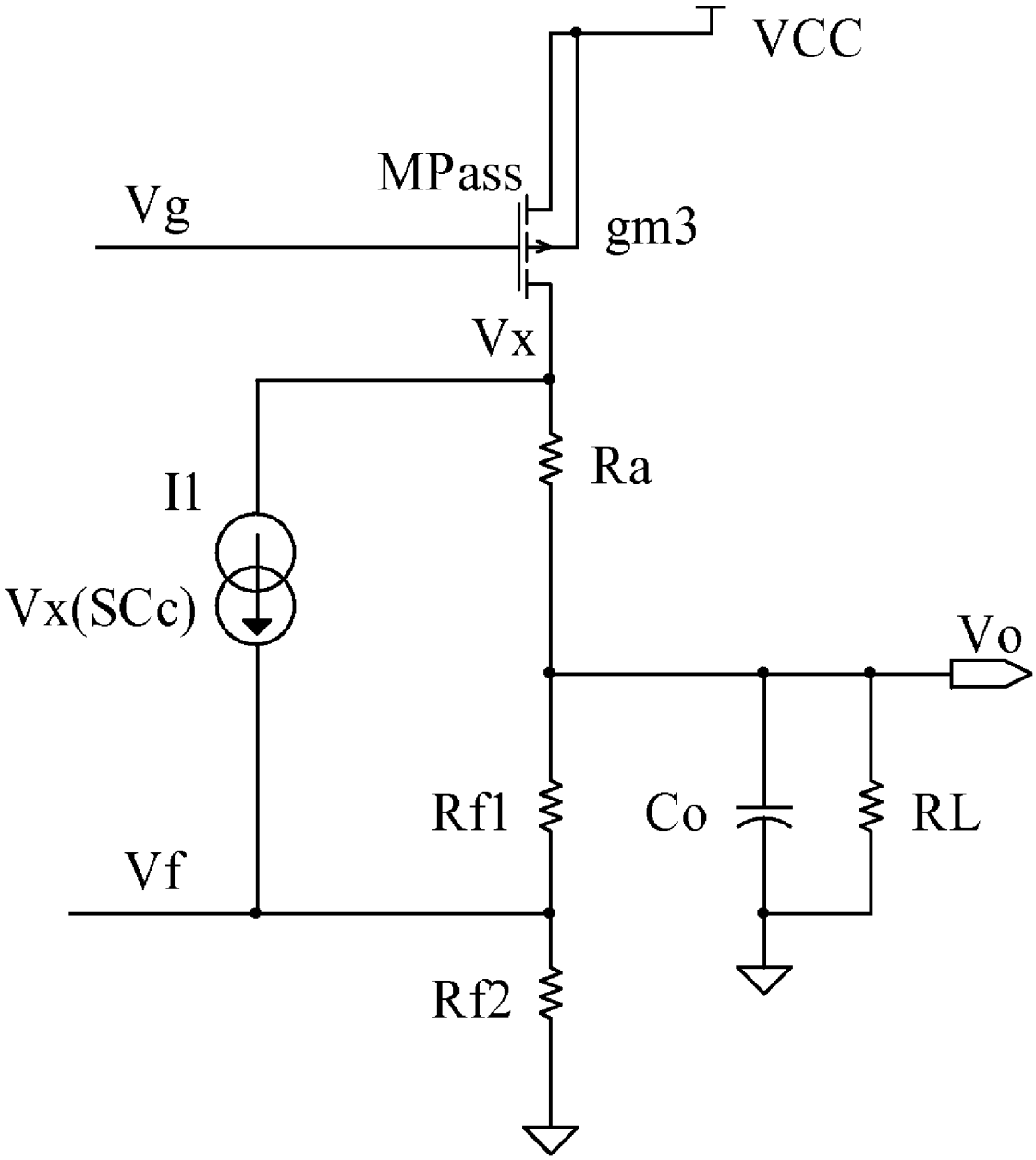
FIG. 6 is a diagram showing a small signal equivalence circuit from Vg to Vf in FIG. 5.

Provided that a voltage of the node C is Vx, and a voltage of a node B between a resistors $R_{f1}$ and a resistor $R_{f2}$ of a feedback circuit is Vf. FIG. 6 is a diagram showing a small signal equivalence circuit from the Vg to the Vf in FIG. 5, wherein the VCCS is replaced by a current source. According to KCL (Kirchhoff's Current Law) at the nodes A, B and C, following three equations is got.

$$g_{m3}V_g = V_x(SC_C) + (V_x - V_O)/R_a \tag{6}$$

$$(V_x - V_O)/R_a = (V_O - V_f)/R_{f1} + V_O \Big/ \left(R_L // \frac{1}{SC_O}\right) \tag{7}$$

$$V_x(SC_C) + (V_O - V_f)/R_{f1} = V_f/R_{f2} \tag{8}$$

Solving these equations and supposing that $R_a \ll R_L \ll R_{f1}$ and $R_a \ll R_L \ll R_{f2}$, we obtain:

$$V_f/V_g = \frac{g_{m3}[R_a R_{f1} S^2 C_C C_O + SC_C R_{f1} + 1]}{\left(1 + \frac{R_{f1}}{R_{f2}}\right)\left[C_C C_O R_a S^2 + SC_O + \frac{1}{R_L}\right]} \tag{9}$$

The equation (9) is a transfer function for the circuit in FIG. 6. The transfer function includes two poles and two zeros. The $R_a \ll R_L$ means that a resistance value of the resistor $R_L$ is an order of magnitude higher than that of the resistor $R_a$ (e.g. $R_a < R_L/10$). Provided that $R_a = 0$, the equation (9) becomes:

$$V_f/V_g = \frac{g_{m3}\lfloor SC_C R_{f1} + 1\rfloor}{\left(1 + \frac{R_{f1}}{R_{f2}}\right)\left[SC_O + \frac{1}{R_L}\right]} \tag{10}$$

Then, one pole and one zero are obtained according to the equation (10).

$$f_{Pa1} = \frac{1}{2\pi R_L C_O},\ f_{Za1} = \frac{1}{2\pi R_{f1} C_C}$$

Finally, another pole and another zero are got after calculation.

$$f_{Pa2} = \frac{1}{2\pi R_a C_C},\ f_{Za2} = \frac{1}{2\pi R_a C_O}$$

In designs, $C_C$ usually is far lower than any one of Co, $C_1$ and $C_2$. Since the resistor $R_a$ and the capacitor $C_c$ both are very small, e.g. $R_a$ is about 0.1 ohm and $C_c$ is 1 pF, the pole $f_{Pa2}$ is pushed to very high frequency and can be neglected.

Taking the pole $f_{p1}$ formed by an output resistor $R_1$ and an output capacitor $C_1$ of the differential amplifier circuit and the pole $f_{p2}$, formed by an output resistor $R_2$ and an output capacitor $C_2$ of the intermediate amplifier circuit into account, the LDO regulator shown in FIG. 5 has three poles and two zeros in all.

$$f_{P1} = \frac{1}{2\pi R_1 C_1},\ f_{P2} = \frac{1}{2\pi R_2 C_2},\ f_{P3} = \frac{1}{2\pi R_L C_O},\ f_{Z1} = \frac{1}{2\pi R_{f1} C_C},$$

$$f_{Z2} = \frac{1}{2\pi R_a C_O}$$

Comparing to the LDO voltage regulator shown in FIG. 1, another zero $f_{z2}$ formed by the resistor $R_a$ and the output capacitor Co is added within bandwidth of the LDO regulator shown in FIG. 2.

To drive 300 mA or bigger current, the pass transistor MPass is designed with a big size so that a big capacitance at node of the gate electrode thereof is generated. The big capacitance of the pass transistor MPass is a part of the capacitor $C_2$. Thus, the pole $f_{P2}$ is taken as a dominant pole. The pole $f_{P1}$ and the pole $f_{P3}$ are canceled by the zero $f_{Z1}$ and the zero $f_{Z2}$, respectively. As a result, the voltage negative feedback loop is very stable and has a phase margin of about 90 degree.

For example, the pole $f_{p1}$ is designed to be adjacent to the zero $f_{z2}$ by choosing values of $R_1$, $C_1$, $R_a$ and $C_o$ so that the pole $f_{P1}$ can be canceled by the zero $f_{Z2}$. In a preferred embodiment, a value of $f_{p1}/f_{z2}$ may be within ⅓~3. Correspondingly, the pole $f_{p3}$ is designed to be adjacent to the zero $f_{z1}$ by choosing values of $R_2$, $C_2$, $R_{f1}$ and $C_c$ so that the pole $f_{p3}$ can be canceled by the zero $f_{z1}$. In a preferred embodiment, a value of $f_{p3}/f_{z1}$ may be within ⅓~3.

A specific design is that $R_L$=11Ω, $C_O$=0.5 uF, $f_{p3}$≈29 KHz; $R_{f1}$=1450 KΩ, Cc=3.8 pF, $f_{z1}$≈29 KHz; $R_a$=0.44Ω, $C_O$=0.5 uF, $f_{z2}$≈716 KHz; R1=112 KΩ, C1=2 pF, $f_{p1}$≈711 KHz.

It should be noted that there are various selections for values of the above parameters. Different parameter selections may result in different domain poles. Furthermore, there is no fixed mode in cancellation of the poles via the zero. Due to addition of the resistor $R_a$, another zero within the bandwidth is provided in the LDO voltage regulator shown in FIG. 2 to cancel one redundant pole so that stability of the feedback loop is increased. For avoiding adversely influence of the resistor $R_a$, the value of the resistor $R_a$ is designed to far less than that of the resistor $R_L$, namely $R_a<R_L/10$. Usually, the value of the resistor $R_a$ is designed to less than 1Ω.

The VCCS in FIG. 5 has a similar structure with the VCCS of FIG. 2. The output terminal of the VCCS is coupled to the node B between the resistors $R_{f1}$ and $R_{f2}$ of the feedback circuit. The input terminal of the VCCS is coupled to a node C between the pass transistor MPass and the resistor $R_a$. In this situation, the voltage on the input terminal of the VCCS has a proportion relation to the output voltage of the LDO voltage regulator. Hence, the minimum output voltage of the LDO voltage regulator shown in FIG. 5 is reduced thereupon.

In the embodiment of FIG. 5, since the resistor $R_a$ requires to satisfy a predetermined condition and avoid an obvious dropout voltage thereon, the resistor $R_a$ must be designed to be very small. The value of the resistor $R_a$ is designed to less than 1Ω. It is difficult to fabricate such a resistor with so small resistance. Hence, the LDO voltage regulator according to the one embodiment is proposed in the present invention to overcome the problem.

Figure 7:
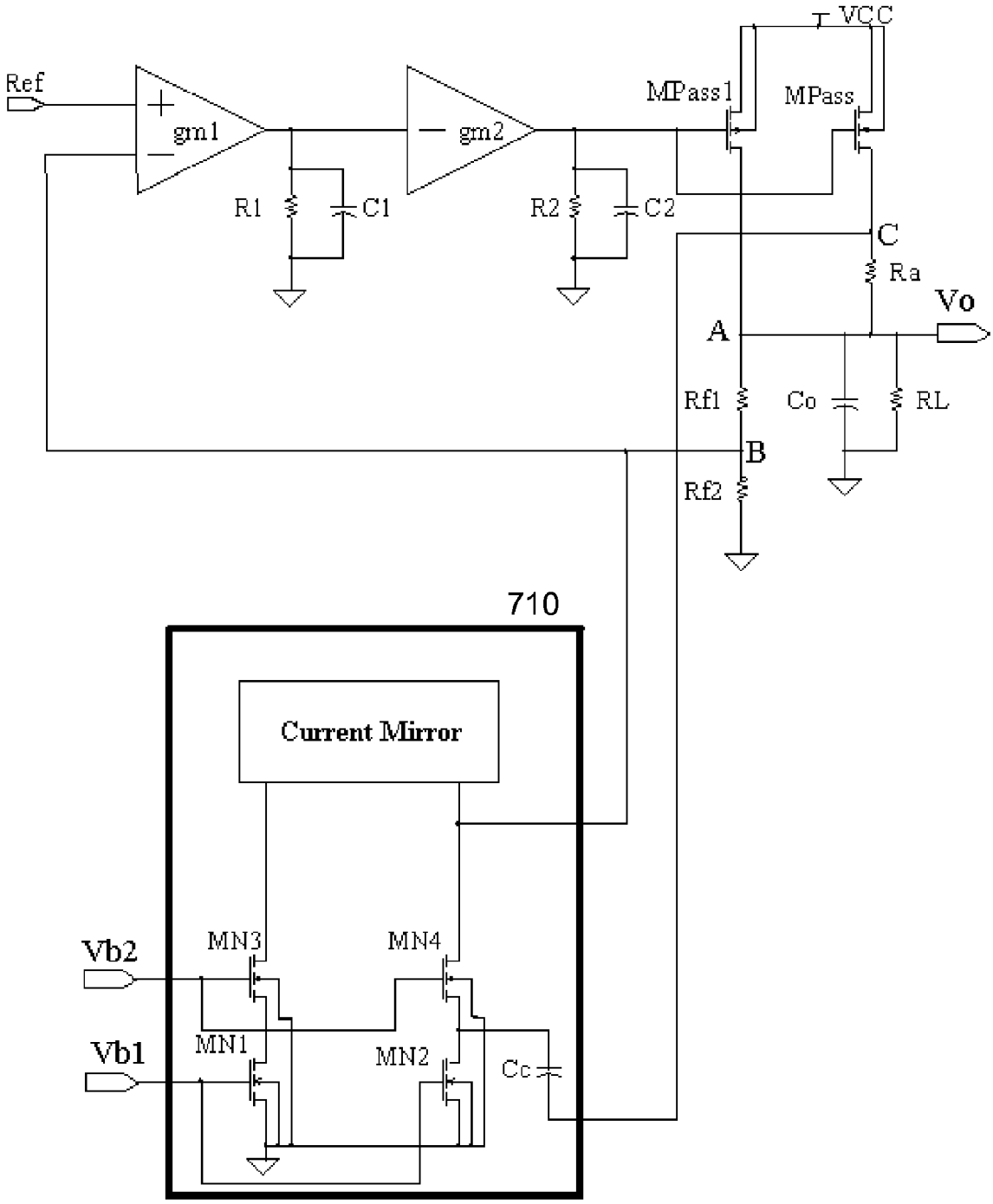
FIG. 7 is a circuit diagram showing the LDO voltage regulator according to a third embodiment of the present invention.

FIG. 7 shows the LDO voltage regulator according to another embodiment of the present invention. In FIG. 7, the output pass circuit includes a pair of P-type pass transistors coupled in parallel between the voltage output node A and the power supply Vcc. One is referred to as the first pass transistor MPass1, the other is referred to as the second pass transistor MPass. The resistor $R_a$ is coupled between the second pass transistor MPass and the voltage output node A. The input terminal of the voltage controlled current source circuit is coupled to the node C between the second pass transistor MPass and the resistor $R_a$.

The ratio P of width to length of the second pass transistor MPass is far less than that O of the first pass transistor MPass1. The ratio N of P to O is within 1/1000~1/100 in a preferred embodiment. The ratio N is 1/900 in this embodiment. Thereby, the current flowing through the second pass transistor MPass is far less than that flowing through the first pass transistor MPass1. In fabrication, one transistor from thousands of P-type MOS transistors coupled in parallel is taken as the second pass transistor MPass, the other transistors are taken as the first pass transistor MPass1.

According to a small signal equivalence circuit from the Vg to the Vf in the LDO regulator shown in FIG. 7, the transfer function can be got by a same way mentioned above. Subsequently, a zero can be got according to similar method in the embodiment of FIG. 4.

$$f_{Z2} = \frac{1}{2\pi R_a C_O / N}$$

The value of the $R_a/N$ in this embodiment may be near to the value of the $R_a$ in the embodiment of FIG. 4, thereby the resistor $R_a$ may has an order of magnitude of 100 Ω.

The VCCS in the embodiment has a similar structure with the VCCS in the embodiment of FIG. 2. The output terminal of the VCCS is coupled to the node B between the resistors $R_{f1}$ and $R_{f2}$ of the feedback circuit. The input terminal of the VCCS is coupled to a node C between the second pass transistor MPass and the resistor $R_a$. In this situation, the voltage on the input terminal of the VCCS has a proportion relation to the output voltage of the LDO voltage regulator. Hence, the minimum output voltage of the LDO voltage regulator shown in FIG. 7 is reduced thereupon.

The present invention has been described in sufficient details with a certain degree of particularity. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

What is claimed is:

1. A LDO voltage regulator comprising:

a differential amplifier circuit having a pair of input terminals and an output terminal, one input terminal coupled to a predetermined reference voltage;

an intermediate amplifier circuit having an output terminal and an input terminal coupled to the output terminal of the differential amplifier circuit; and an output pass circuit including a pass transistor and an output capacitor, the pass transistor having a control terminal coupled to the output terminal of the intermediate amplifier circuit, an input terminal coupled to a power supply and an output terminal as a voltage output node, the output capacitor coupled between the voltage output node and a ground reference;

a feedback circuit including a pair of ladder resistors coupled in series between the voltage output node and the ground reference, a node between the ladder resistors coupled to the other input terminal of the differential amplifier circuit; and a voltage controlled current source (VCCS) having an input terminal coupled to the voltage output node and an output terminal coupled to the node between the ladder resistors, wherein the VCCS includes four NMOS field effect transistors MN1, MN2, MN3 and MN4, a current mirror and a compensation capacitor $C_c$, a gate electrode of the MN1 is coupled to a first predetermined voltage Vb1 and a source electrode of the MN1 is grounded, a gate electrode of the MN2 is coupled to the first predetermined voltage Vb1 and a source electrode of the MN2 is grounded, a gate electrode of the MN3 is coupled to a second predetermined voltage Vb2, a source electrode of the MN3 is coupled to a drain electrode of the MN1 and a drain electrode of the MN3 is coupled to an input terminal of the current mirror, a gate electrode of the MN4 is coupled to the second predetermined voltage Vb2, a source electrode of the MN4 is coupled to a drain electrode of the MN2 and a drain electrode of the MN4 is coupled to an output terminal of the current mirror, the drain electrode of the MN4 serves as the output terminal of the VCCS, one terminal of the compensation capacitor $C_c$ is coupled to the drain electrode of the MN2 and the other terminal of the compensation capacitor $C_c$ serves as the input terminal of the VCCS.

2. The LDO voltage regulator according to claim 1, wherein the output pass circuit further comprises an output resistor coupled between the output terminal of the pass transistor and the voltage output node, and wherein the input terminal of the VCCS is coupled to a node between the pass transistor and the output resistor.

3. The LDO voltage regulator according to claim 1, wherein the pass transistor is a P-type MOS field effect transistor, a gate electrode of the MOS field effect transistor serves as the control terminal, a source electrode of the MOS field effect transistor serves as the input terminal and a drain electrode of the MOS field effect transistor serves as the output terminal.

4. The LDO voltage regulator according to claim 1, wherein the VCCS is designed for only injecting a small signal current into the node between the ladder resistors.

5. The LDO voltage regulator according to claim 1, wherein a ratio of an input direct current to an output direct current of the current mirror is equal to $(W/L)_{MN2}/(W/L)_{MN1}$, $(W/L)_{MN2}$ denotes a ratio of width to length of the MN2 and $(W/L)_{MN1}$ denotes a ratio of width to length of the MN1, and wherein ratios of width to length of the MN3 and the MN4 satisfies $(W/L)_{MN4}/(W/L)_{MN3}=(W/L)_{MN2}/(W/L)_{MN1}$, $(W/L)_{MN3}$ denotes a ratio of width to length of the MN3 and $(W/L)_{MN4}$ denotes a ratio of width to length of the MN4.

6. The LDO voltage regulator according to claim 1, wherein a transconductance gm4 between the drain electrode and the source electrode of the MN4 is an order of magnitude higher than an output resistor Ro2 of the MN2.

7. The LDO voltage regulator according to claim 2, further comprising a load resistor coupled between the voltage output terminal and the ground reference.

8. The LDO voltage regulator according to claim 7, wherein a resistance value of the output resistor is an order of magnitude less than that of the load resistor which is an order of magnitude less than that of either of the ladder resistors.

9. The LDO voltage regulator according to claim 8, wherein a capacitance value of the compensation capacitor of the VCCS is an order of magnitude less than minimum capacitance value among an output capacitor of the differential amplifier circuit, an output capacitor of the intermediate amplifier circuit and the output capacitor of the output pass circuit.

10. The LDO voltage regulator according to claim 9, wherein the LDO voltage regulator has a zero formed by the output capacitor and the output resistor of the output pass circuit.

11. The LDO voltage regulator according to claim 1, wherein the output pass circuit further comprises another pass transistor coupled in series with the pass transistor and an output resistor, a control terminal of the another pass transistor is coupled to the output terminal of the intermediate amplifier circuit, an input terminal of the another pass transistor coupled to a power supply and an output terminal of the another pass transistor is coupled to one terminal of the output resistor, the other terminal of the output terminal is coupled to the voltage output node, and wherein the input terminal of the VCCS is coupled to a node between the another pass transistor and the output resistor.

12. The LDO voltage regulator according to claim 11, wherein a ratio of width to length of the pass transistor is O, a ratio of width to length of the another pass transistor is P, then the ratio N of O to P is within 100~1000.

13. A voltage controlled current source (VCCS), comprising:

four NMOS field effect transistors MN1, MN2, MN3 and MN4, a current mirror and a compensation capacitor $C_c$, wherein a gate electrode of the MN1 is coupled to a first predetermined voltage Vb1 and a source electrode of the MN1 is grounded, a gate electrode of the MN2 is coupled to the first predetermined voltage Vb1 and a source electrode of the MN2 is grounded, a gate electrode of the MN3 is coupled to a second predetermined voltage Vb2, a source electrode of the MN3 is coupled to a drain electrode of the MN1 and a drain electrode of the MN3 is coupled to an input terminal of the current mirror, a gate electrode of the MN4 is coupled to the second predetermined voltage Vb2, a source electrode of the MN4 is coupled to a drain electrode of the MN2 and a drain electrode of the MN4 is coupled to an output terminal of the current mirror, the drain electrode of the MN4 serves as an output terminal of the VCCS, one terminal of the compensation capacitor $C_c$ is coupled to the drain electrode of the MN2 and the other terminal of the compensation capacitor $C_c$ serves as an input terminal of the VCCS.

14. The voltage controlled current source according to claim 13, wherein a ratio of an input direct current to an output direct current of the current mirror is equal to $(W/L)_{MN2}/(W/L)_{MN1}$, $(W/L)_{MN2}$ denotes a ratio of width to length of the MN2 and $(W/L)_{MN1}$ denotes a ratio of width to length of the MN1, and wherein ratios of width to length of the MN3 and the MN4 satisfies $(W/L)_{MN4}/(W/L)_{MN3}=(W/L)_{MN2}/(W/L)_{MN}$, $(W/L)_{MN3}$ denotes a ratio of width to length of the MN3 and $(W/L)_{MN4}$ denotes a ratio of width to length of the MN4.

15. The voltage controlled current source according to claim 13, wherein a transconductance gm4 between the drain electrode and the source electrode of the MN4 is an order of magnitude higher than an output resistor Ro2 of the MN2.

* * * * *